United States Patent [19]

Gaston

[11] Patent Number: 4,516,693

[45] Date of Patent: May 14, 1985

[54] SANITARY DRINKING WATER SYSTEM

[76] Inventor: Roy T. Gaston, Rte. 2, Box 483-H, Pell City, Ala. 35125

[21] Appl. No.: 529,384

[22] Filed: Sep. 6, 1983

[51] Int. Cl.[3] ..... B65D 25/16; B65D 25/42

[52] U.S. Cl. ..... 222/105; 222/183; 248/100; 251/9

[58] Field of Search ..... 222/105, 181, 183; 220/404; 248/99, 100; 383/9; 251/9

[56] References Cited

U.S. PATENT DOCUMENTS

| | | | |
|---|---|---|---|
| 711,410 | 10/1902 | Means | 248/100 |
| 3,112,047 | 11/1963 | Weinreich et al. | 222/105 |
| 3,198,390 | 8/1965 | Beckman et al. | 222/181 X |
| 3,587,934 | 6/1971 | Elmore et al. | 222/181 |
| 3,638,834 | 2/1972 | Goodrich et al. | 222/105 |

FOREIGN PATENT DOCUMENTS

| | | | |
|---|---|---|---|
| 2263953 | 10/1975 | France | 220/404 |

*Primary Examiner*—Joseph J. Rolla

*Assistant Examiner*—Frederick R. Handren

*Attorney, Agent, or Firm*—Pitts and Brittian

[57] ABSTRACT

A sanitary water barrel for use on construction job sites and the like. This system employs a substantially standard barrel that has been modified to accept a replaceable plastic liner. The exterior of the water barrel near the upper end thereof is provided with radially extending hook members to engage with apertures placed near the upper periphery of a replaceable liner. The liner is provided with an integral spout which is passed through an opening in the side wall of the barrel. A weight- and spring-biased closure mechanism normally bears against the spout of the liner as it leaves the barrel causing the closing of the spout and therefore prevents water leakage therefrom. Water is caused to flow by raising a lever on the valve when desired. These special liners can be fabricated in a roll type fashion similar to garbage bags with perforated tear lines provided to separate each individual liner unit.

3 Claims, 5 Drawing Figures

Fig. 3
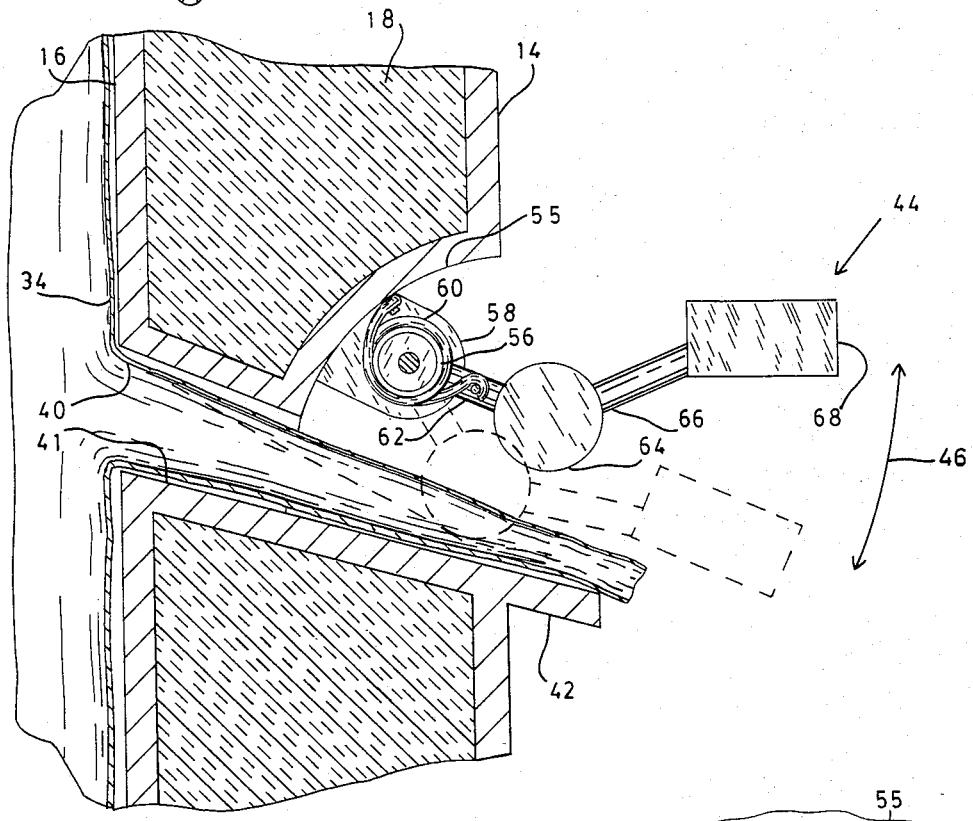
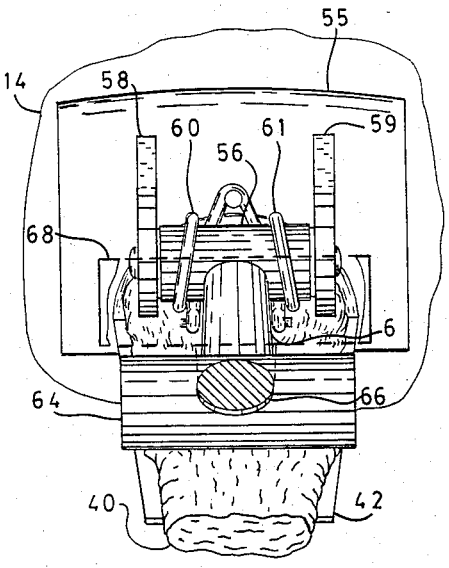
Fig. 4

SANITARY DRINKING WATER SYSTEM

BACKGROUND OF THE INVENTION

This invention is generally related to fluid dispensing apparatus, and more particularly to water barrels used for drinking water on construction sites.

Portable water barrels are frequently used by employees of telephone, power and construction crews when at remote locations. These persons have for years been forced to drink water from the "same ole barrels". Fresh water is usually dumped in each morning, but the inside of the container builds up potentially unhealthy layers. Very few of the barrels are ever closed, and the ones which are cleaned are not cleaned very well. Often this cleaning involves just a rinse using a garden hose; at some sites not even a hose is available. Sickness of some individuals has been attributed to unsanitary barrels.

Three types of barrels have generally been used: oak stave barrels; metal barrels; and more recently, plastic barrels with a hard and thick liner. All of these barrels are impossible to keep clean inside due to the permanent linings.

Accordingly, it is a primary object of the present invention to provide a water barrel having disposable linings for achieving sanitary drinking water. Other objects of the invention will become apparent upon a consideration of the drawings and description which follow.

SUMMARY OF THE INVENTION

According to the present invention, a barrel is provided for the storage of drinking water in a sanitary manner, which barrel has an easily installed disposable bag lining having a spout for the dispensing of the water. A pinch-type valve on the barrel controls the dispensing.

BRIEF DESCRIPTION OF THE DRAWINGS

FIG. 3 is an enlarged cross-sectional view of a portion of the barrel, the spout of the liner and the shut off valve mechanism used in the unit of FIG. 1, showing the valve in an open position in solid lines, and in the closed position with phantom lines.

FIG. 4 is a plan view of the shut off valve mechanism shown in FIG. 3, with a portion of the barrel cut away.

DETAILED DESCRIPTION OF THE INVENTION

Figure 1:
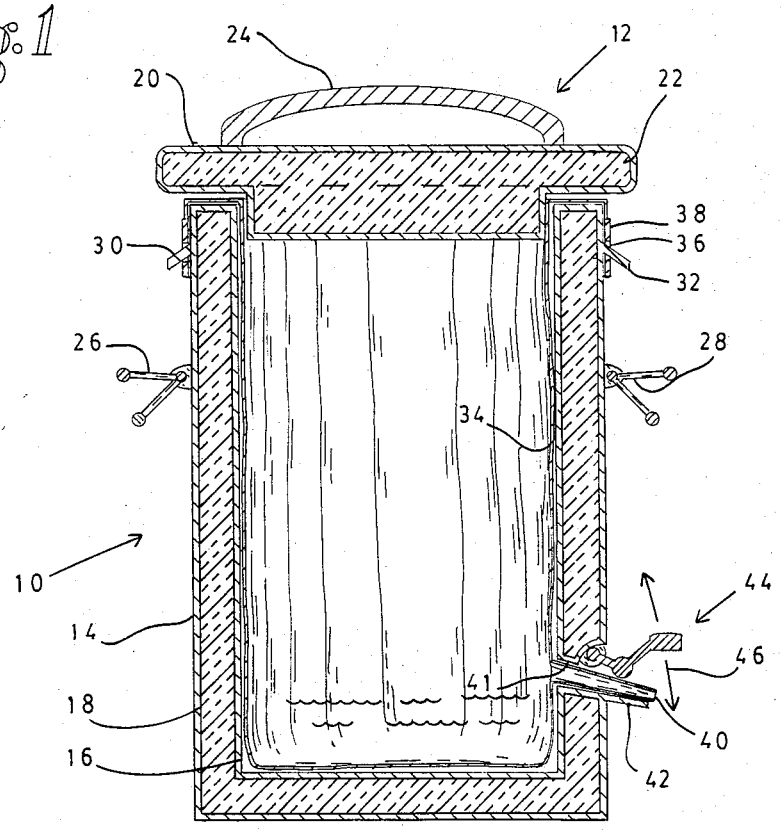
FIG. 1 is a vertical cross-sectional view of the present sanitary drinking water system.
Figure 2:
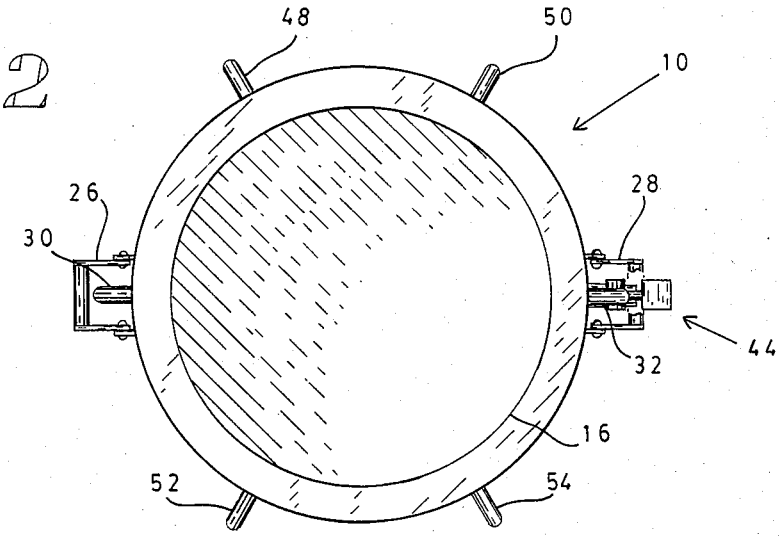
FIG. 2 is a top view of the unit of FIG. 1, with the cover removed, showing the positioning of hooks which hold the sanitary disposable liner.

Referring now specifically to FIGS. 1 and 2, shown therein is the present sanitary drinking system. A barrel 10 is shown having a removable cover 12. The barrel 10 is of substantially standard construction, typically having a hollow shell 14 defining a cylindrical cavity 16 with the volume within the hollow shell filled with a suitable insulation 18. In a similar manner, the cover is fabricated with a shell 20 filled with insulation material 22, and a handle 24 is provided on top. The external surface of the barrel is provided with conventional carrying handles 26, 28.

Projecting outwardly from the barrel 10, near the open end of the cavity 16, are a plurality of hooks 30, 32. As indicated in FIG. 2, additional hooks are equally spaced about the periphery of the barrel. Positioned within the cavity 16 is a liner 34 which extends over the top of the barrel and is provided with apertures 36 to engage the aforementioned hooks. This liner is reinforced as at 38 near these apertures. In addition, the liner 34 is provided with a spout 40 as an integral part thereof. Spout 40 projects through an opening 41 in the wall of the barrel 10. This opening is provided with a tapered surface 42 whose purpose will be described hereinafter. Mounted adjacent the opening 41 is a valve unit 44 which moves in a direction as indicated by the arrow 46. Details of this valve mechanism will be described with respect to FIGS. 3 and 4. The aforementioned liner 34 is fabricated from thin plastic similar to a plastic garbage bag such that this liner will hold water and ice where desired. Not shown in this figure is a removeable tip that is on the spout 40 (see FIG. 5).

The top view of the water barrel of FIG. 1 is shown in FIG. 2 with the top 12 removed. It may be seen therein that additional hooks 48–54 are shown so that there are a total of six hook units equally spaced about the perphery of the barrel.

A more detailed view of the shut off valve 44 is illustrated in FIGS. 3 and 4. Mounted within a generally concave recess 55 in the exterior wall of the shell 14 is a transverse shaft 56. This is supported in a pair of brackets 58, 59. Interposed between the shaft 56 and the brackets (or shell) are tension springs 60, 61 which bias the valve 44 in a closed position as indicated below. Projecting radially from the shaft 56 is an arm 62 having at its opposite end a cylindrical cut off bar 64. Projecting radially from this cut off bar 64 is a second arm 66, having at its extremity a weighted handle 68. Shown in FIG. 3 is the valve in an open condition with the solid lines, and in a closed position with the phantom lines. FIG. 4 shows the valve in a closed position. The combined weight of the handle 68 and the action of the springs 60, 61 cause the cut off bar 64 to depress the spout 40 of the liner 34 against the aforementioned surface 42 of the opening 41 such that no flow can occur through the spout 40. Upon lifting the handle 68 in the direction indicated by the arrow 46, flow resumes. It may be noted that this shut off valve differs from that used in conventional water barrels in that it is a lift type valve as opposed to the traditional thumb depressing mechanism or rotary valve.

Figure 5:
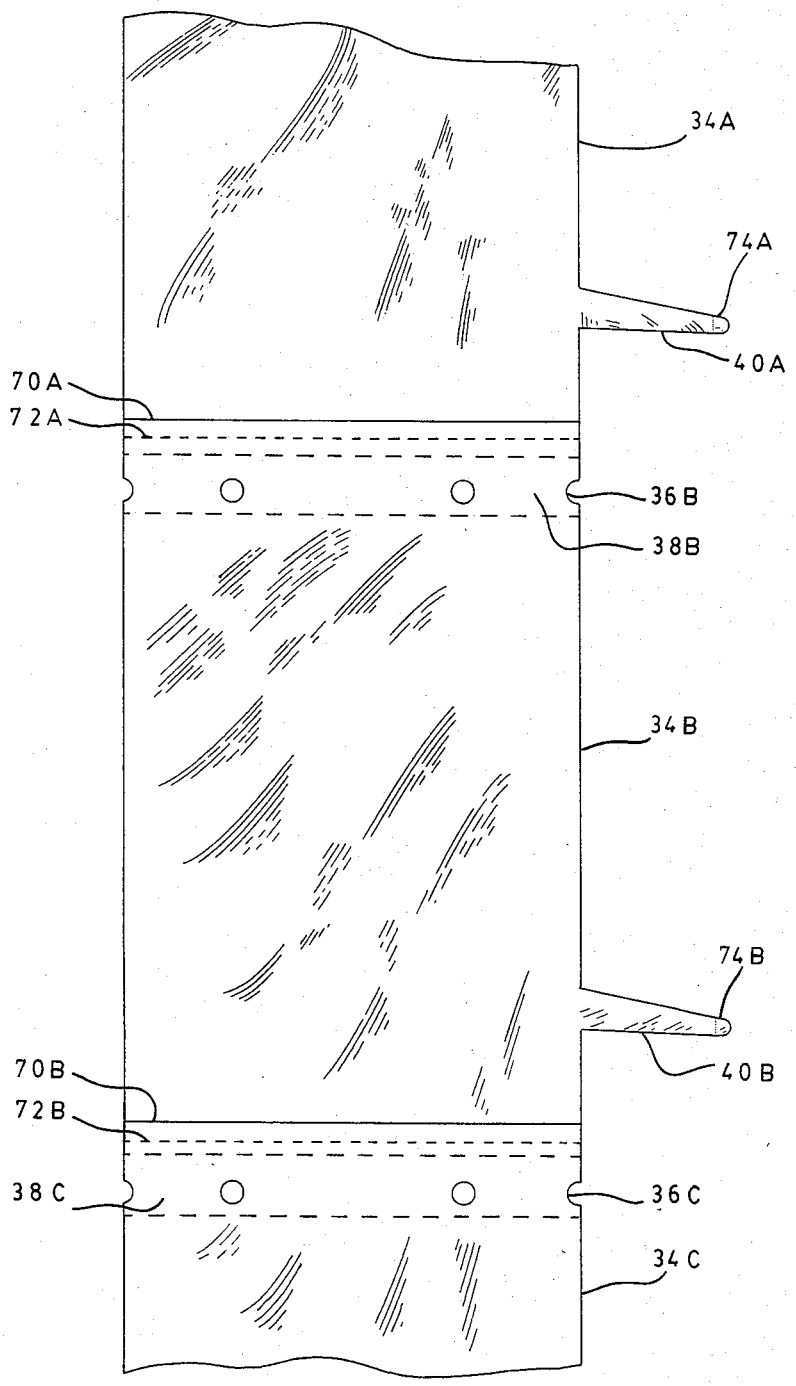
FIG. 5 is a side view of a plurality of liners of the invention, as releasably attached in series, suitable for storage in a roll.

Referring now to FIG. 5, shown therein is an illustration of a plurality of liners 34 as indicated in FIG. 1, attached in series so that the same may be stored in a roll. As indicated, liner 34A is releasably attached to line 34B with a series of tear perforations 72A. The liner 34A is sealed at the bottom with a fusion seal 70A. In a like manner, liner 34B is sealed at the bottom with a fusion seal 70B and releasably joined to liner 34C with a series of tear perforations 72B. Each of the liners has formed therein the appropriate apertures 36 for engagement with the hooks on the exterior surface of the barrel. For example, holes 36B and their reinforcement 38B, are shown together with corresponding holes 36C and their re-enforcement 38C. Formed as part of the liners are the corresponding spouts 40A, 40B of the type shown in FIG. 1 and FIG. 3. Attached to each of these spouts is a tear off tip 74A, 74B, which can be removed after the liner has been inserted into the appropriate water barrel. These tips, in addition to providing further sanitary conditions, assist in feeding the spouts through the opening in the wall of the water barrel.

From the foregoing it may be seen that a disposable and sanitary liner is provided for a unique water barrel with a combination providing a sanitary drinking water system.

I claim:

1. A sanitary drinking water system for construction sites and the like, which comprises:

a barrel having an open top end and a closed bottom end and a cylindrical wall defining a cylindrical cavity, said barrel being provided with an opening through said wall adjacent said closed end, said opening defining an extended surface;

a removable lid for said open end of said barrel;

a plurality of hooks projecting outwardly from said barrel proximate said open end;

a replaceable flexible liner disposed within said cavity, said liner having a closed end disposed adjacent said closed end of said barrel and an open end extending from said open end of said barrel, said open end of said liner being provided with reinforced apertures releasably engaged with said hooks;

a spout attached to and communicating with said liner disposed adjacent said closed end of said liner and disposed within said opening in said wall of said barrel; and a pinch valve mounted on the external surface of said barrel proximate said opening for normally closing said spout against any flow from said liner, said valve including a lever pivoted from said barrel wall, said lever carrying a cylindrical cut off bar to deform said spout against said extended surface upon action of gravity, and for permitting flow from said liner upon upward movement of said lever.

2. The system of claim 1 wherein said lever of said valve is pivotally connected to a transverse rotatable shaft mounted within brackets attached to said barrel, and further comprises a tension spring surrounding said shaft and attached between said brackets and said lever to bias said valve in the closed position.

3. The system of claim 1 wherein said spout is provided with a removable closed tip.

* * * * *